United States Patent [19]

Davis

[11] 4,331,961

[45] May 25, 1982

[54] WINDSHIELD ANTENNA

[76] Inventor: Ross A. Davis, 95-461 Kaulia Pl., Mililani Town, Hi. 96789

[21] Appl. No.: 138,853

[22] Filed: Apr. 8, 1980

[51] Int. Cl.[3] ..... H01Q 1/32

[52] U.S. Cl. ..... 343/704; 343/713

[58] Field of Search ..... 343/711, 713, 704

[56] References Cited

U.S. PATENT DOCUMENTS 3,971,029 7/1976 Torii et al. ..... 343/713

3,971,030 7/1976 Sauer ..... 343/713

*Primary Examiner*—Eli Lieberman

*Attorney, Agent, or Firm*—Bruce L. Birchard

[57] ABSTRACT

The coupling of radio signals, to and from the surface of a conductive body and to and from associated radio apparatus is optimized by adding, proximate to the edge of an opening (such as a window) in the body, a closed loop of relatively highly conductive material, such as copper, and coupling said radio signals to said associated radio apparatus through a plurality of interconnected adjacent loops proximate to said closed loop to maintain proper proportion of E fields and H fields in the signals fed to associated radio apparatus.

12 Claims, 8 Drawing Figures

WINDSHIELD ANTENNA

BACKGROUND OF THE INVENTION

1. Field of the Invention

This invention relates to radio antennas and, more specifically, to such antennas which rely upon the R.F. currents which flow around a region of low electrical conductance in a body of higher electrical conductance.

2. Prior Art

I have numerous patents on antennas which tap the large R.F. currents flowing in relatively massive bodies, such as car bodies. For example, see U.S. Pat. No. 4,003,056 issued Jan. 16, 1977. While the antennas covered by these patents perform well, I have continued my research and development in an attempt to increase the signals taken from the conductive bodies, reduce directionality of those signals and minimize antenna installation costs.

Therefore, it is an object of this invention to provide a low-cost, high-performance conductive body antenna, particularly for use in automobiles.

SUMMARY OF THE INVENTION

Oppositely wound, driven loops are supported adjacent the conductive perimeter of an opening in a large metallic body, for example, a car body. Such loops pick up both the electrostatic and electromagnetic components of radio signals incident upon the metallic body. The electrostatic component is essentially omnidirectional, while the electromagnetic component gives freedom from corona (electrostatic) noise and operation in adverse reception areas, such as in tunnels, underpasses, buildings, and mountains. Great signal enhancement is realized by inserting a closed, highly conductive loop around the driven loops and in proximity to the conductive perimeter of the body opening. Additional signal enhancement is realized by tuning the driven loops.

BRIEF DESCRIPTION OF THE DRAWINGS

My invention, both as to its nature and operation, may best be understood by the description which follows, taken in conjunction with the drawings herein, in which.

DETAILED DESCRIPTION OF THE PREFERRED EMBODIMENTS

Figure 1:
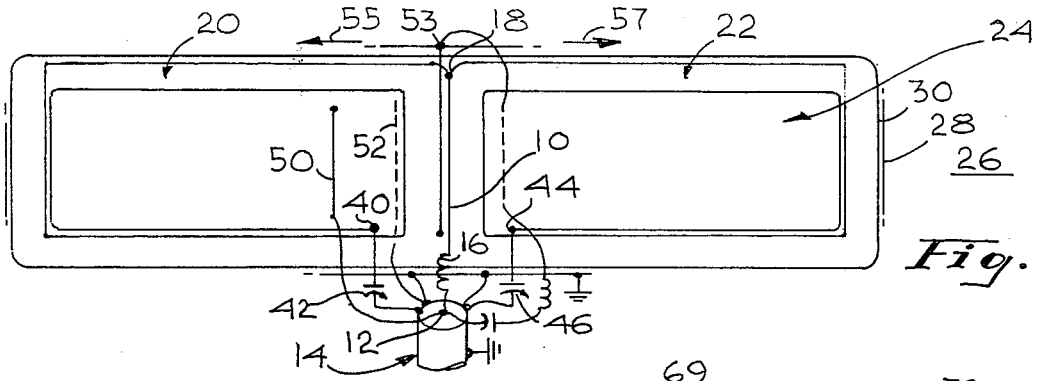
FIG. 1 is a schematic representation of a first embodiment of my invention.

In FIG. 1, conductor 10, which is coupled to center conductor 12 of coax 14 through R.F. choke 16 is bi-furcated at point 18 and forms two oppositely wound loops 20 and 22 in opening 24 of conductive body 26, which may be an automobile body. Body 26 has a conductive edge 28. Proximate to edge 28, a closed loop 30 is provided. Loop 30 may be a wire or a printed conductor but, in any event, it is of highly conductive material, such as copper. Shorted loop 30 may be connected to edge 28, or left floating, electrically. Edge 28 is, of course, a body of steel or other construction material with good mechanical strength but of moderate to low electrical conductivity, e.g., a car body. Loop 20 ends at terminal 40 which is coupled through tuning condenser 42 to coaxial sheath 14 which is at ground potential for R-F purposes. Loop 22 ends at point 44 which is coupled thru tuning condenser 46 to grounded sheath 14. Conductor 50 and its associated conductor 52, constitute an F-M antenna nominally peaked at 88 M.C. Choke 16 isolates F-M signals flowing in loops 20 and 22 from flowing into coaxial 14 center conductor 12. Conductor 51 connected to "hot" signal point 53 picks up C-B signals flowing around edge 28 in the direction shown by arrows 55,57.

Figure 2:
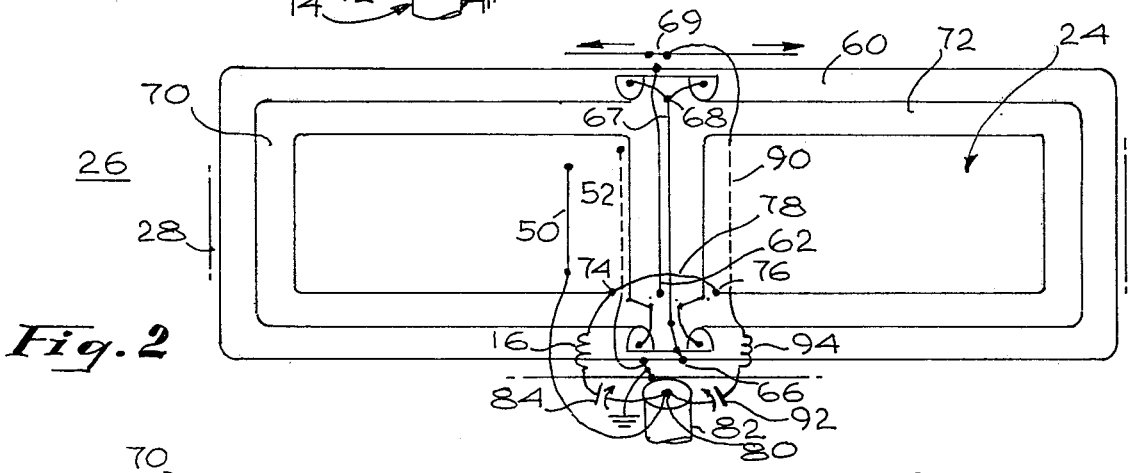
FIG. 2 is a schematic diagram of a second embodiment of my invention with one method of tuning.

In FIG. 2 shorted turn 30 of FIG. 1 has been replaced by a tightly braided, highly conductive sheath 60, which may be of copper. Sheath 60 is a closed loop for R-F purposes. It does have openings to permit passage of conductor 67 which is grounded to edge 28 at point 66 and which is bi-furcated at point 68 to form loops 70 and 72. Loops 70 and 72 end at terminals 74 and 76, respectively. Terminals 74 and 76 are joined by conductor 78 and are connected to inner conductor 80 of coax 82 through R-F choke 16 and tuning condenser 84 which may be fixed or variable to tune loops 70,72. Elements 50, 52 constitute the F-M antenna. Conductor 90 forms part of the C-B antenna and is coupled through tuning condenser 92 and R-F choke 94 to inner conductor 80 of coax 82. The edge 28 also carries R-F currents for C-B operation in opposite directions from point 69 around the periphery of opening 24. Wire 62 is an exciter wire.

Figure 3:
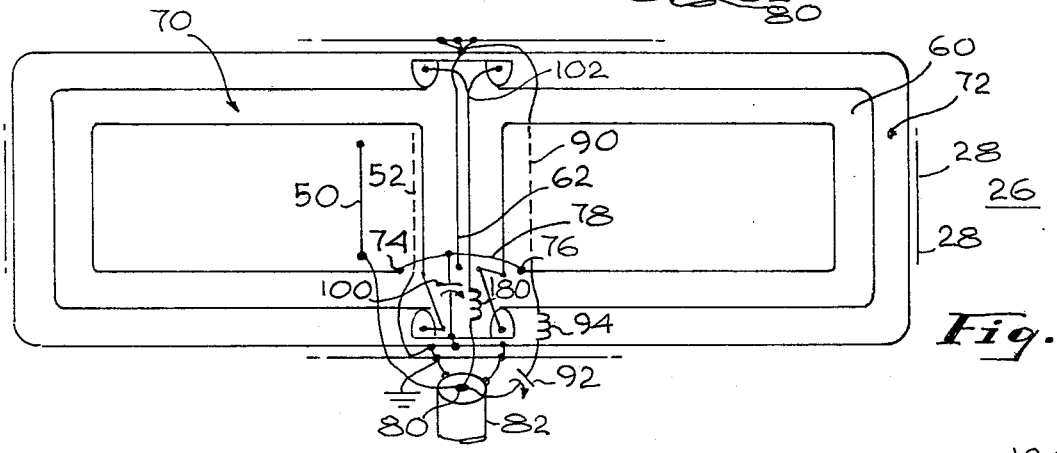
FIG. 3 is a schematic diagram of my invention with an alternative tuning method.

In FIG. 3, the shorted-turn loop is again formed by sheath 60 which is connected to conductive edge 28.

Conductor 78 joins end terminals 74, 76 and loops 70 and 72 are tuned by condenser 100 which is connected between conductor 78 and ground. Conductor 102, which bi-furcates to form loops 70, 72, emerges to be connected to inner conductor 80 of coax 82 through R.F. choke 180.

Figure 4:
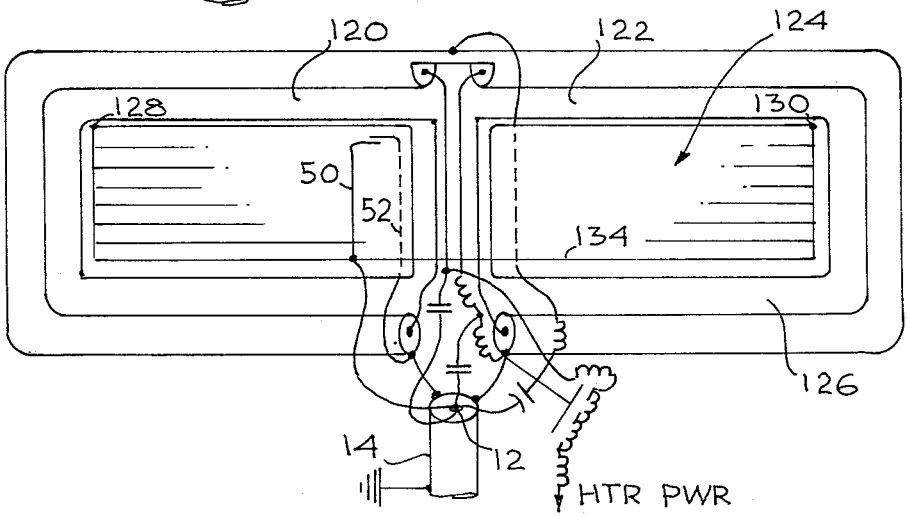
FIG. 4 is a schematic diagram of my invention coupled with a de-froster in an automobile environment.

In FIG. 4, loops 120 and 122 are formed, in part, of defroster 124. The size of conductors 126 in loops 120, 122 must be increased to handle the defroster current. Coupling of loop 120 to defroster 124 occurs at point 128. Coupling of loop 122 to defroster 124 occurs at point 130. Appropriate noise filtering of the D-C supply to the defroster 124 is provided. C-B and F-M antenna elements are provided, as before.

Figure 5:
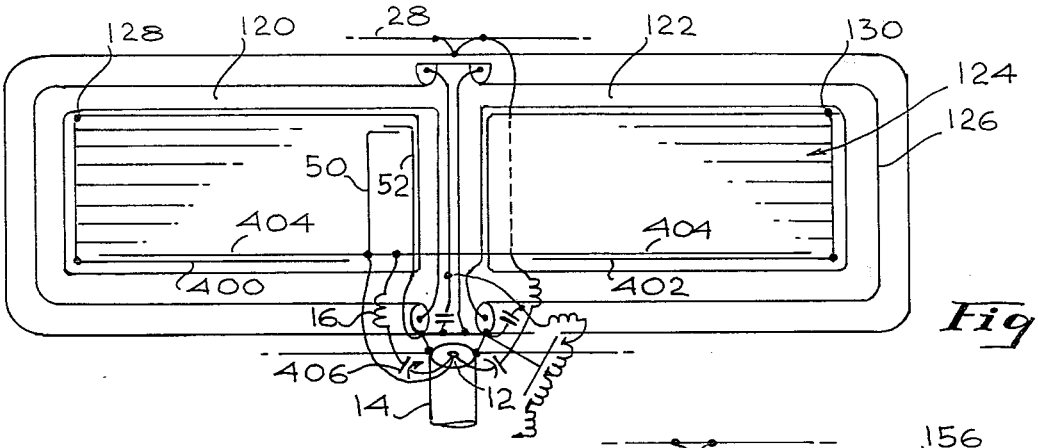
FIG. 5 is another form of FIG. 4, but with tuning added.

In FIG. 5, de-froster 124 is coupled to loops 120 and 122 at points 128, 130, respectively. R-F is taken out of the combination by means of capacitive coupling between conductors 400, 402 and conductor 404. Tuning condenser 406 tunes the combination. The other elements function as before.

Figure 6:
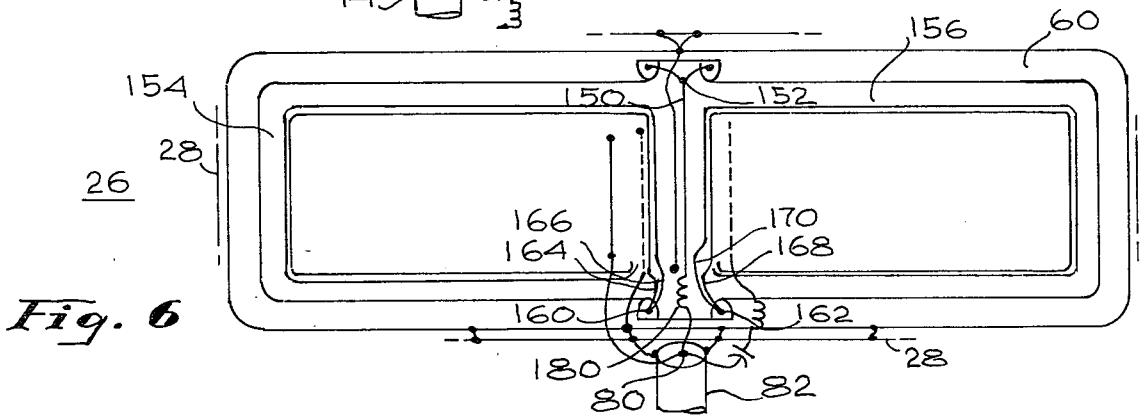
FIG. 6 is a schematic diagram of another embodiment of my invention showing multiple parallel-connected conductors in the loop portion thereof.

In FIG. 6, conductor 150 is bifurcated at point 152 to form loops 154, 156. The shortened turn coupling to edge 28 is provided by sheath 60, which may be connected to edge 28 along its length. Leads 160, 162 emerging from sheath 60 are bifurcated, as shown, and form the oppositely wound loops 154, 156. The double conductors 164, 166 and 168, 170 forming loops 154, 156, respectively, show lower inductive reactance than the single conductors in earlier embodiments. Choke 180 isolates F-M signals from center conductor 80. Lead 150 is coupled to center conductor 80 of coax 82 through R-F choke 180.

Figure 7:
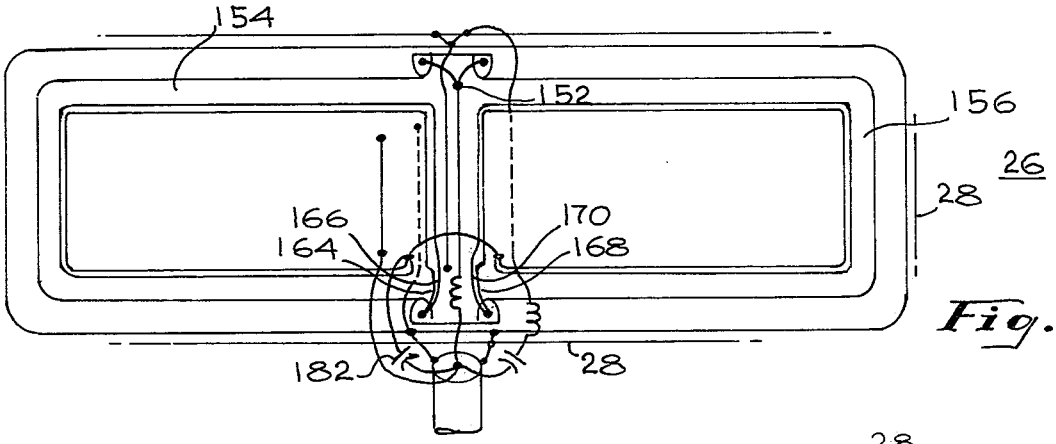
FIG. 7 is a schematic diagram of a method for tuning the antenna of FIG. 6; and, FIG. 8 is a schematic diagram of an additional embodiment of my antenna invention.

If tuning of loops 154, 156 is desired, the circuit of FIG. 7 may be used. Conductors 164, 166, 168 and 170 in FIG. 7 are connected together and through tuning condensor 182 to ground.

Figure 8:
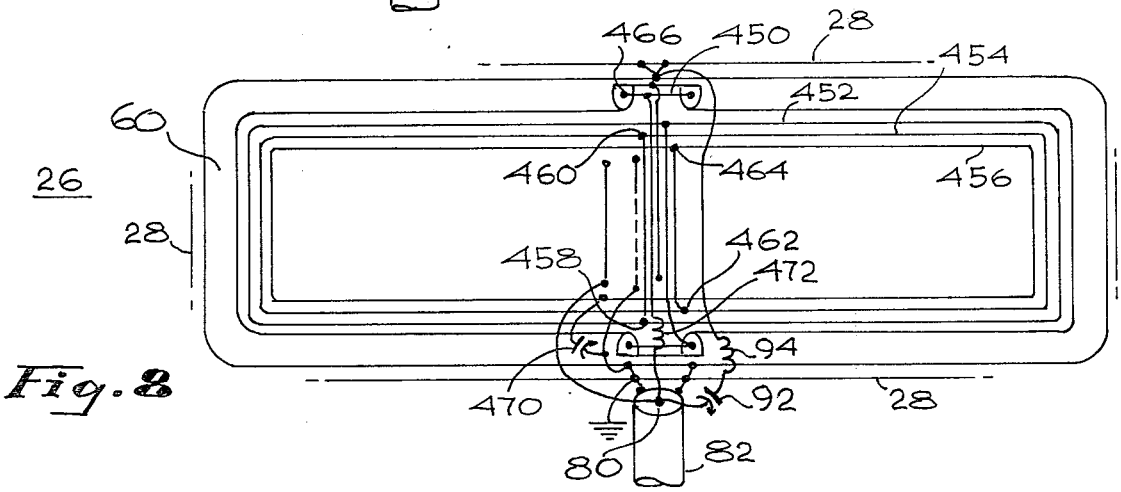

In FIG. 8, sheath 60 is connected to edge 28 of conductive body 26. It forms a closed loop. Within it is inner conductor 450 which forms a second loop. Three additional loops 452, 454 and 456 spaced progressively further from edge 28, are provided. While three additional loops are shown it should be understood that a greater or lesser number could be used.

The lower, or low potential side, of each loop is connected to the upper or high potential side of the next smaller loop. For example, point 458 on loop 452 is connected to point 460 on loop 454. Similarly, point 462 on loops 454 is connected to point 464 on loop 456. The output R-F from the system is taken from point 466 on loop 450 to inner conductor 80 of coax 82 through R-F choke 472. Tuning can be done by condenser 470.

The closed loop which is an important part of this invention may take a number of forms besides those described thus far. For example, the molding around a car window is often aluminum and if the two halves of which it is usually made are joined solidly for electrical purposes and are connected through low resistance means, such as bronze clips, to the conductive edge of the body opening at the top and bottom center regions of such edge, the requirement for a short-circuited turn will be satisfied. A highly conductive metal may be deposited on or bonded to the edge 28. The edge 28 may be made hollow so as to act as the outer conductor of a coax, or a tube of highly conductive material bonded thereto to so act.

While particular embodiments have been shown and described it would be apparent to one skilled in the art that variations and modifications may be made without departing from the scope of my invention. It is the purpose of the attached claims to cover all such variations and modifications.

What is claimed is:

1. A conductive-body antenna system responsive to both E-field and H-field components of radio signals, including:

an electrically conductive body having at least one opening therein to form a conductive edge, a closed exciter loop member of material having good electrical conductivity positioned adjacent to said conductive edge along substantially its entire length and coupled closely thereto for R-F purposes;

at least one driven loop positioned within said closed exciter loop member and coupled thereto for R-f purposes; and, means for coupling said driven loop to external radio apparatus.

2. Apparatus according to claim 1 in which said driven loop is tuned to an operating frequency.

3. Apparatus according to claim 1 in which the number of driven loops is two, they are open loops and the conductor in one driven loop is wound oppositely to the conductor in the other driven loop.

4. Apparatus according to claim 1 in which said driven loop includes multiple, parallel conductors.

5. Apparatus according to claim 1 in which said closed exciter loop is a hollow, conductive sheath.

6. Apparatus according to claim 5 in which the number of driven loops is two and each is wound in the opposite direction from the other and each originates from a common lead which is bi-furcated.

7. Apparatus according to claim 6 in which the first turn of each driven loop passes through said hollow, conductive sheath.

8. Apparatus according to claim 7 which includes, in addition, a defroster coupled to each of said driven loops.

9. Apparatus according to claim 3 in which the open ends of said open driven loops are connected to each other and are coupled to an output coax.

10. Apparatus according to claim 3 in which the open ends of said open loops are connected to each other and to R-F ground.

11. Apparatus according to claim 1 in which said closed exciter loop member is connected with low-electrical resistance-material to said conductive edge in the region of the top and bottom center thereof.

12. Apparatus according to claim 1 in which said conductive edge has a bonded surface of high-electrical-conductivity material.

* * * * *